US006069309A

United States Patent [19]

Monahan et al.

[11] Patent Number: 6,069,309

[45] **Date of Patent: *May 30, 2000**

[54] DATA COMPRESSION OF SOUND DATA

[75] Inventors: Kevin J. Monahan; Donna L. Murray, both of Santa Cruz, Calif.

[73] Assignee: Creative Technology Ltd., Singapore

[ * ] Notice: This patent is subject to a terminal disclaimer.

[21] Appl. No.: 09/229,141

[22] Filed: Jan. 12, 1999

Related U.S. Application Data

[62] Division of application No. 08/931,436, Sep. 16, 1997, Pat. No. 5,877,446, which is a continuation of application No. 08/686,054, Jul. 24, 1996, abandoned, which is a continuation of application No. 08/414,148, Mar. 30, 1995, abandoned, which is a continuation of application No. 08/252,066, Jun. 1, 1994, abandoned, which is a continuation of application No. 07/876,113, Apr. 28, 1992, abandoned, which is a continuation of application No. 07/465,732, Jan. 18, 1990, abandoned.

[51] Int. Cl.[7] ..... G10H 1/057; G10H 1/08; G10H 1/20

[52] U.S. Cl. ..... 84/603; 84/657; 84/660; 84/663; 84/DIG. 10

[58] Field of Search ..... 84/603–607, 619, 84/622–625, 627, 639–642, 657, 659–661, 663, DIG. 9, DIG. 10, DIG. 26

[56] References Cited

U.S. PATENT DOCUMENTS

| | | | |
|---|---|---|---|
| 4,348,929 | 9/1982 | Gallitzendörfer | 84/607 |
| 4,520,708 | 6/1985 | Wachi | 84/607 |
| 4,633,749 | 1/1987 | Fujimori et al. | 84/607 |
| 4,635,520 | 1/1987 | Mitsumi | 84/607 |
| 4,701,745 | 10/1987 | Waterworth | 340/347 |
| 4,916,996 | 4/1990 | Suzuki et al. | 84/603 |
| 5,016,009 | 5/1991 | Whiting et al. | 341/67 |
| 5,050,474 | 9/1991 | Ogawa et al. | 84/603 |
| 5,086,685 | 2/1992 | Hanzawa et al. | 84/605 |
| 5,094,136 | 3/1992 | Kudo et al. | 84/603 |
| 5,430,241 | 7/1995 | Furuhashi et al. | 84/603 |
| 5,877,446 | 3/1999 | Monahan et al. | 84/603 |

*Primary Examiner*—Stanley J. Witkowski
*Attorney, Agent, or Firm*—Townsend and Townsend and Crew LLP

[57] ABSTRACT

A data compression method and apparatus for the compression of sound data utilized in digital sampling keyboard instructs. The present invention reduces memory requirements for sampled sounds without compromising sound quality, using three techniques. The third technique improves the defect of formant distortion when sampled sounds are transposed.

12 Claims, 15 Drawing Sheets

DATA COMPRESSION OF SOUND DATA

CROSS-REFERENCE TO RELATED APPLICATIONS

This application claims priority from, and is a divisional of, Ser. No. 08/931,436 filed Sep. 16, 1997 and now U.S. Pat. No. 5,877,446 which is continuation of Ser. No. 08/686,054, filed Jul. 24, 1996, now abandoned; which is a continuation of Ser. No. 08/414,148, filed Mar. 30, 1995, now abandoned; which is a continuation of Ser. No. 08/252,066, filed Jun. 1, 1994, now abandoned; which is a continuation of Ser. No. 07/876,113, filed Apr. 28, 1992, now abandoned; which is a continuation of Ser. No. 07/465,732, filed Jan. 18, 1990, now abandoned.

BACKGROUND OF THE INVENTION

The present invention relates to data compression of sound data, and more particularly to the data compression of sound data utilized in digital sampling keyboard instruments.

Since the introduction of digital sampling keyboard instruments, the desire to compress sound data into smaller memories without compromising sound quality is ever increasing. In recent years, limiting bit resolution (8 to 12 bits) and sample rates (less than 44.1 Khz) have been two common methods to reduce memory size. But since the introduction of the compact disk (CD), resolution less than 16 bit and 44.1 Khz has largely been deemed unacceptable.

Another common approach, looping, involves repeating a section of data during the time a key is depressed. Two common types of loops are single period forwards loops and cross-faded forwards loops (see FIGS. 1 and 2). Single period (or single cycle) loops characteristically sound quite static, as only one period is repeated. They work best on solo instruments with non-complex harmonic structures. Longer loops, on the other hand, are required for ensemble sounds and harmonically complex solo sounds. Often, the sound data must be processed to avoid pops in the loop. This process is called cross/fade looping. Portions of the sound at the loop start and end points are cross/faded loop contains more dynamics than a single-cycle loop. However, some lower frequency phase cancellation occurs as a result.

The start point of a cross/faded loop must begin after the attack phase of the sound has passed and the sound becomes more stable. The problem here is that it often takes a while for a sound to become stable. If a loop is started too close to the attack, poor loops result due to large fluctuations in phase and amplitude, and there is a high risk of attack data becoming part of the loop.

Yet another method for reducing memory is to simply take fewer samples of a given instrument across the keyboard. A single sample of a violin will use less memory than one that has been sampled every half octave. The problem here is that the realism of the sound disintegrates rapidly when too few samples are used to represent a fixed formant instrument.

SUMMARY OF THE INVENTION

It is an object of the present invention to provide an improved data compression method and apparatus to be utilized with digital sampling keyboard instruments.

A more particular object of the invention is to reduce memory requirements for sampled sounds without compromising sound quality, using three techniques. Additionally, the third technique improves the defect of formant distortion when sampled sounds are transposed.

Briefly, the present invention is directed toward, in one preferred embodiment, an improved method for processing sound data samples where the data samples have an attack portion and a cross/faded loop portion, including the step of deleting the sound data between the attack portion and just before the loop start portion. The improved method further includes the step of digitally splicing the remaining attack and loop portions to form a spliced data sample.

Additional objects, advantages and novel features of the present invention will be set forth in part in the description which follows and in part become apparent to those skilled in the art upon examination of the following, or may be learned by practice of the invention. The objects and advantages of the present invention may be realized and attained by means of the instrumentalities and combinations which are pointed out in the appended claims.

BRIEF DESCRIPTION OF THE DRAWINGS

The accompanying drawings which are incorporated in and form a part of this specification illustrate an embodiment of the invention and, together with the description, serve to explain the principles of the invention.

DETAILED DESCRIPTION OF THE INVENTION

Reference will now be made in detail to the preferred embodiment of the invention, an example of which is illustrated in the accompanying drawings. While the invention will be described in conjunction with the preferred embodiment, it will be understood that it is not intended to limit the invention to that embodiment. On the contrary, it is intended to cover alternatives, modifications and equivalents as may be included within the spirit and scope of the invention as defined by the appended claims.

Figure 1:
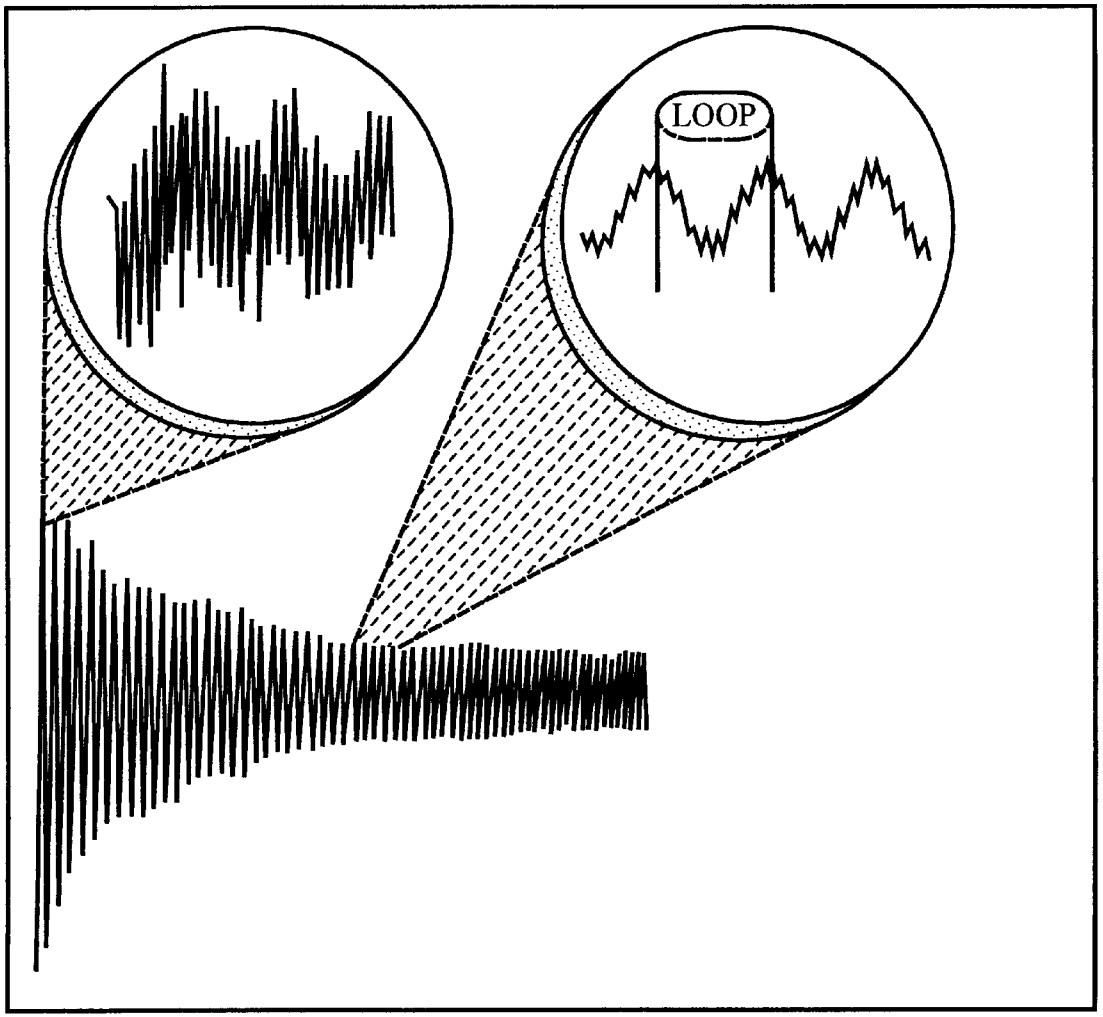
FIG. 1 depicts a single-cycle forwards loop.
Figure 2:
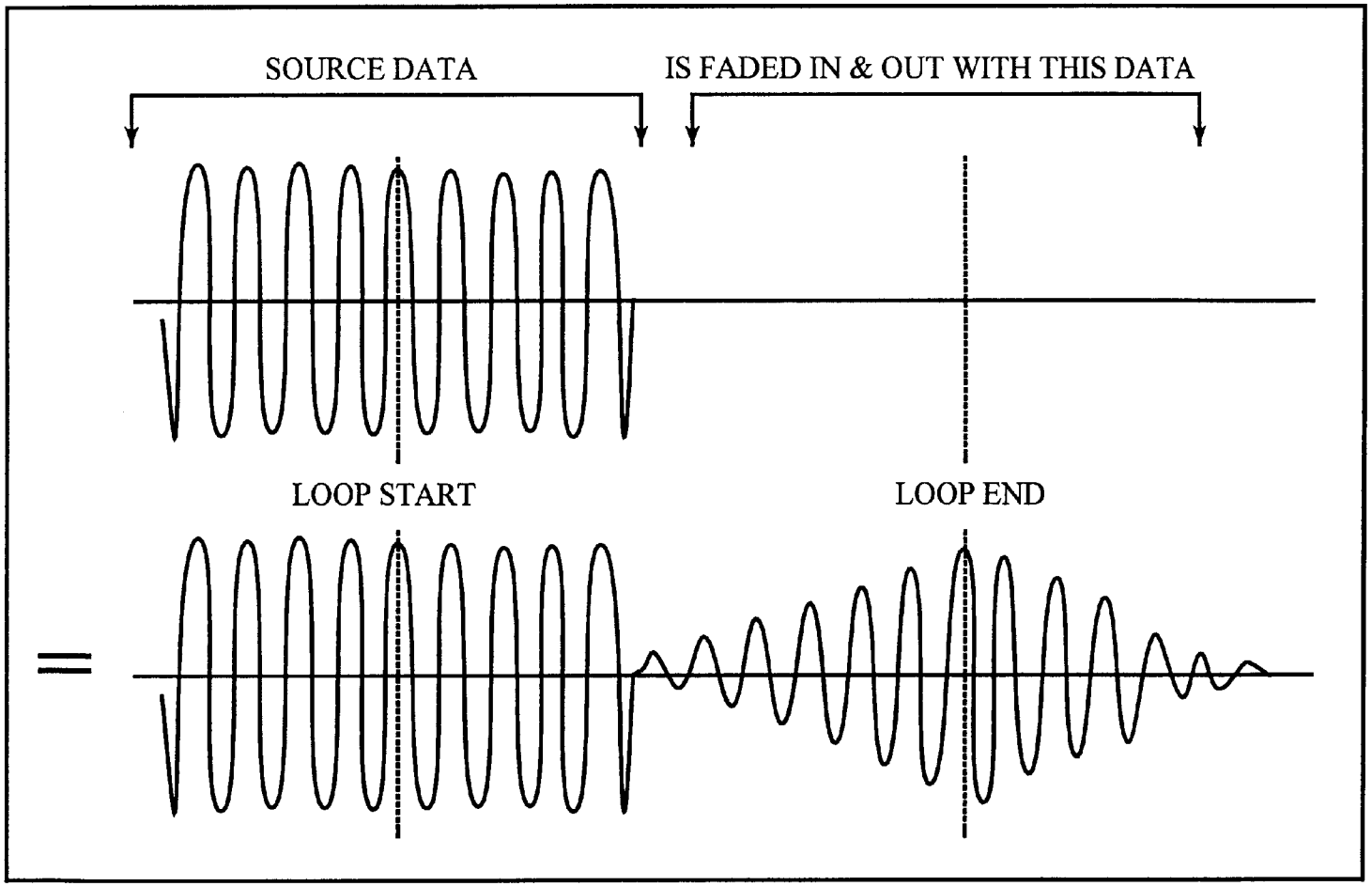
FIG. 2 depicts a cross/fade looping process.
Figure 3:
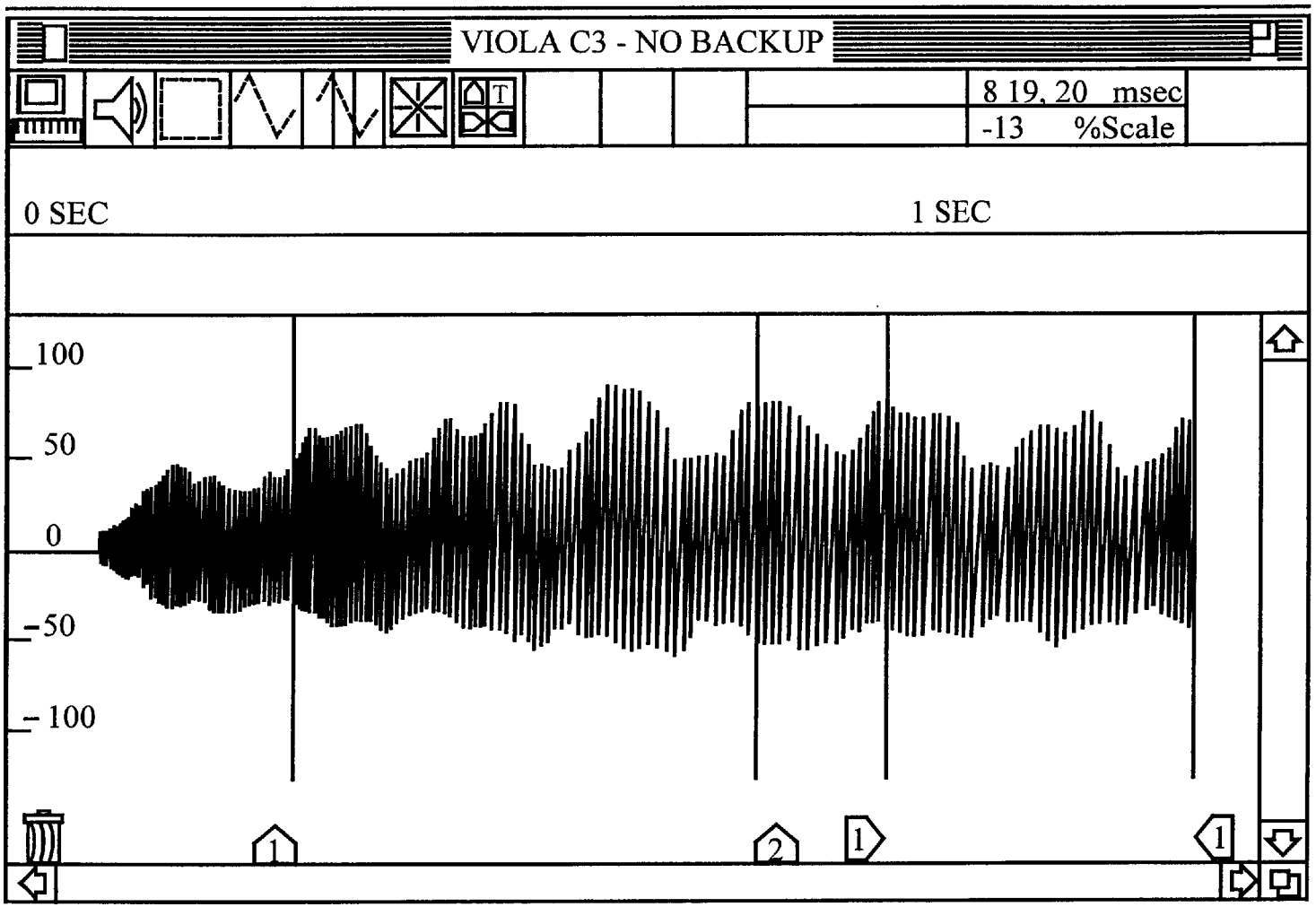
FIG. 3 depicts a conventional cross/faded loop.
Figure 4:
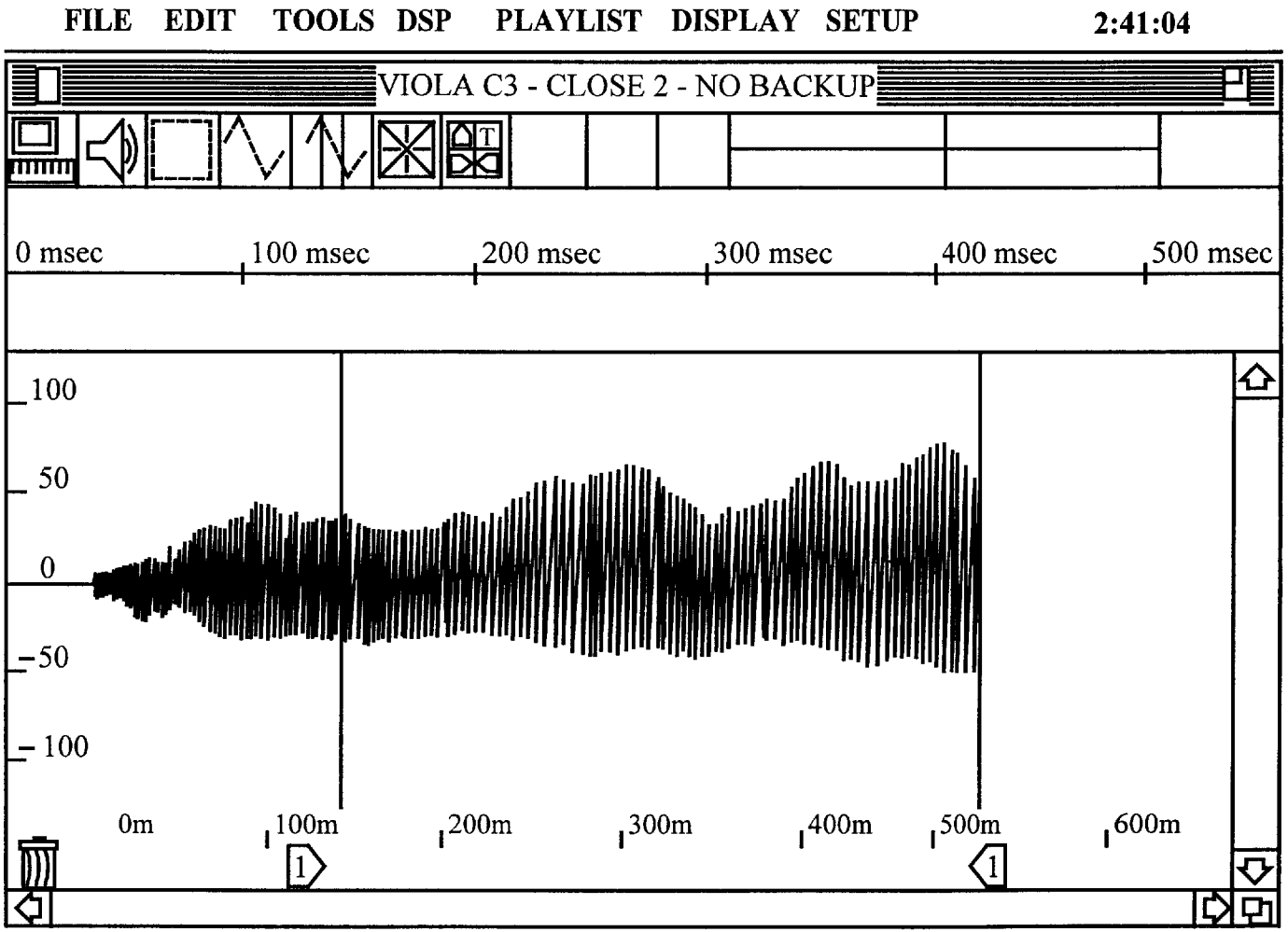
FIG. 4 depicts a conventional cross/faded loop too close to attack.
Figure 5:
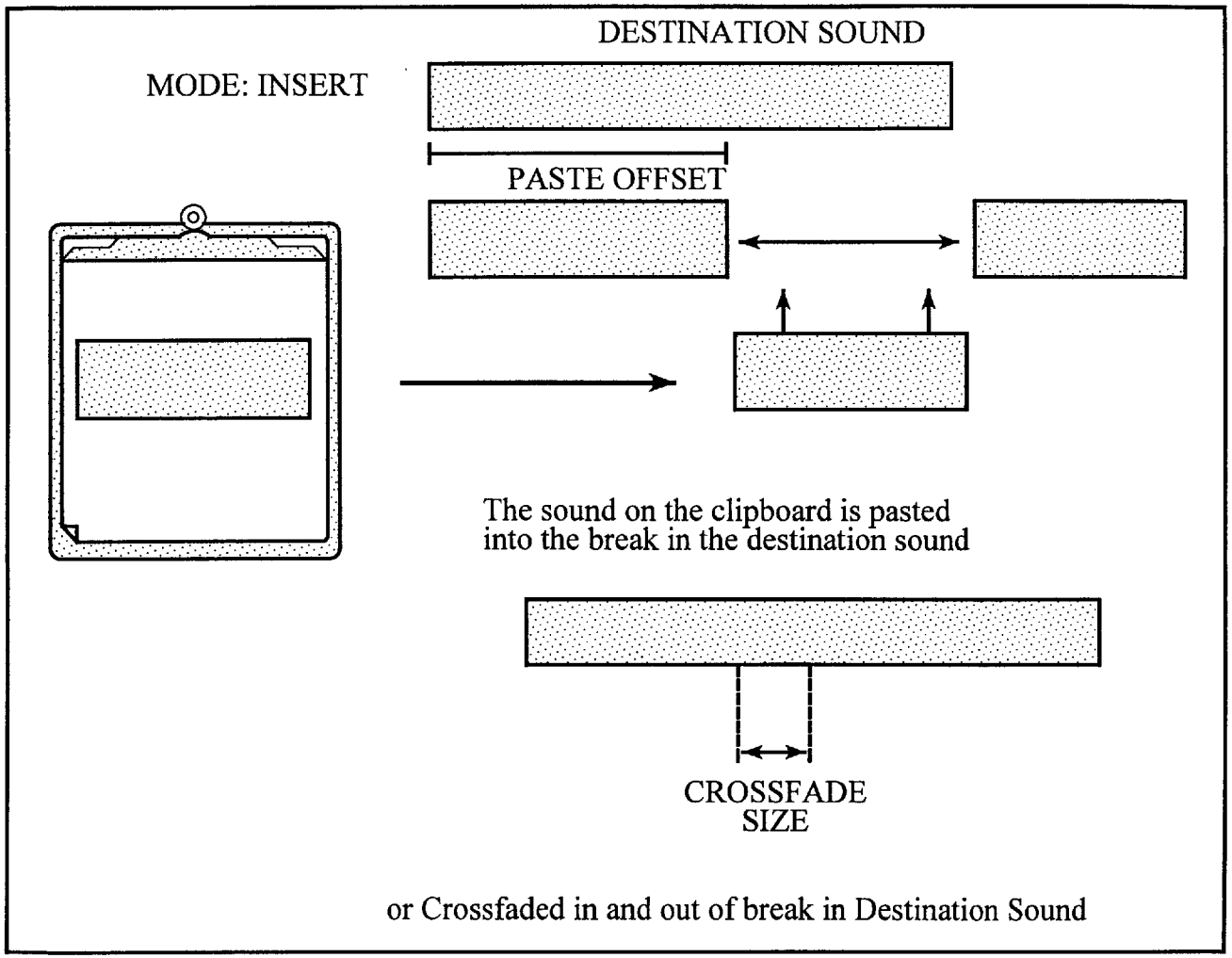
FIG. 5 depicts cut, copy and paste procedures.
Figure 6:
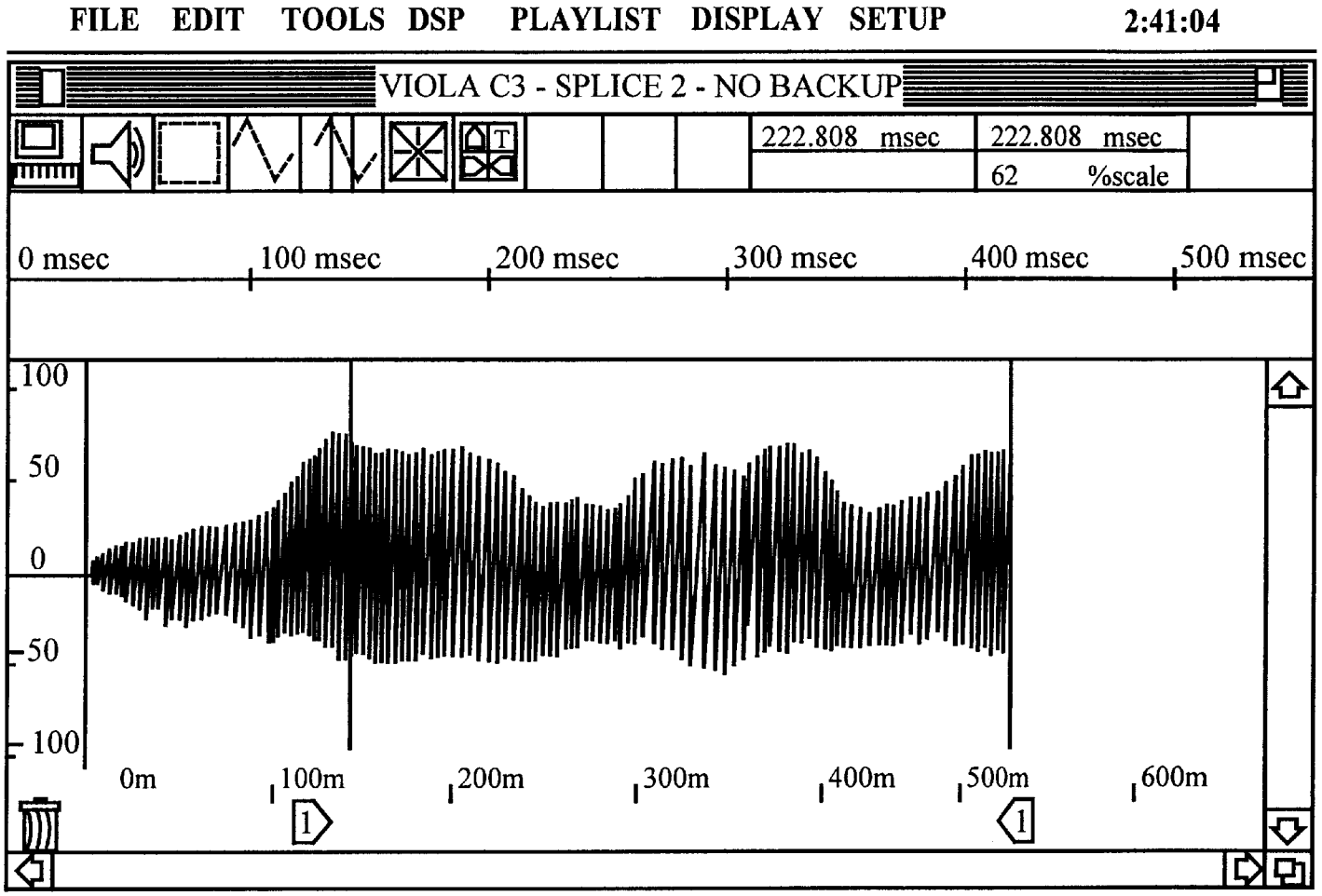
FIG. 6 depicts attack/loop splice.

One technique according to the present invention for data reduction (FIGS. 3–6) utilizes cut and paste editing tools to reduce a sound to its most essential components, attack and loop (sustain). FIG. 3 shows a string sample that has been cross-fade looped well after the attack. Sonically, this example is correct, but requires more memory than is desirable (57K). In FIG. 4, the same sample has been looped much closer to the attack of the sound, producing the desired memory reduction (22K) but now the loop contains elements of the attack. Because of the instability of the sound at that point in time, the loop has an undesirable amount of fluctuation.

Returning to FIG. 3, it can be seen that the sound data between the attack (approximately 125 ins) and just before the loop start (approximately 100 ins) can be deleted. The remaining portion (the attack and loop) can be digitally spliced together with up to 100 ms X/fade time. The X/fade will prevent any audible pop in the splice and the fade time is limited by the size of data before the loop start, which in this case is 100 ms or 4410 bytes at 44.1 Khz sample rate. (See FIG. 5)

The resulting sample (FIG. 6) not only saves memory but can sound significantly better than the example in FIG. 3, because the unstable portion of the sample has been eliminated.

A second technique (FIGS. 7–11) according to the present invention utilizes a phase linear filter to separate a sample into multiple bands that can be individually processed and looped much closer to the attack, then digitally recombined. The use of finite impulse response digital filters of consistent order between bands insures no phase distortion of the result after recombining.

Figure 7:
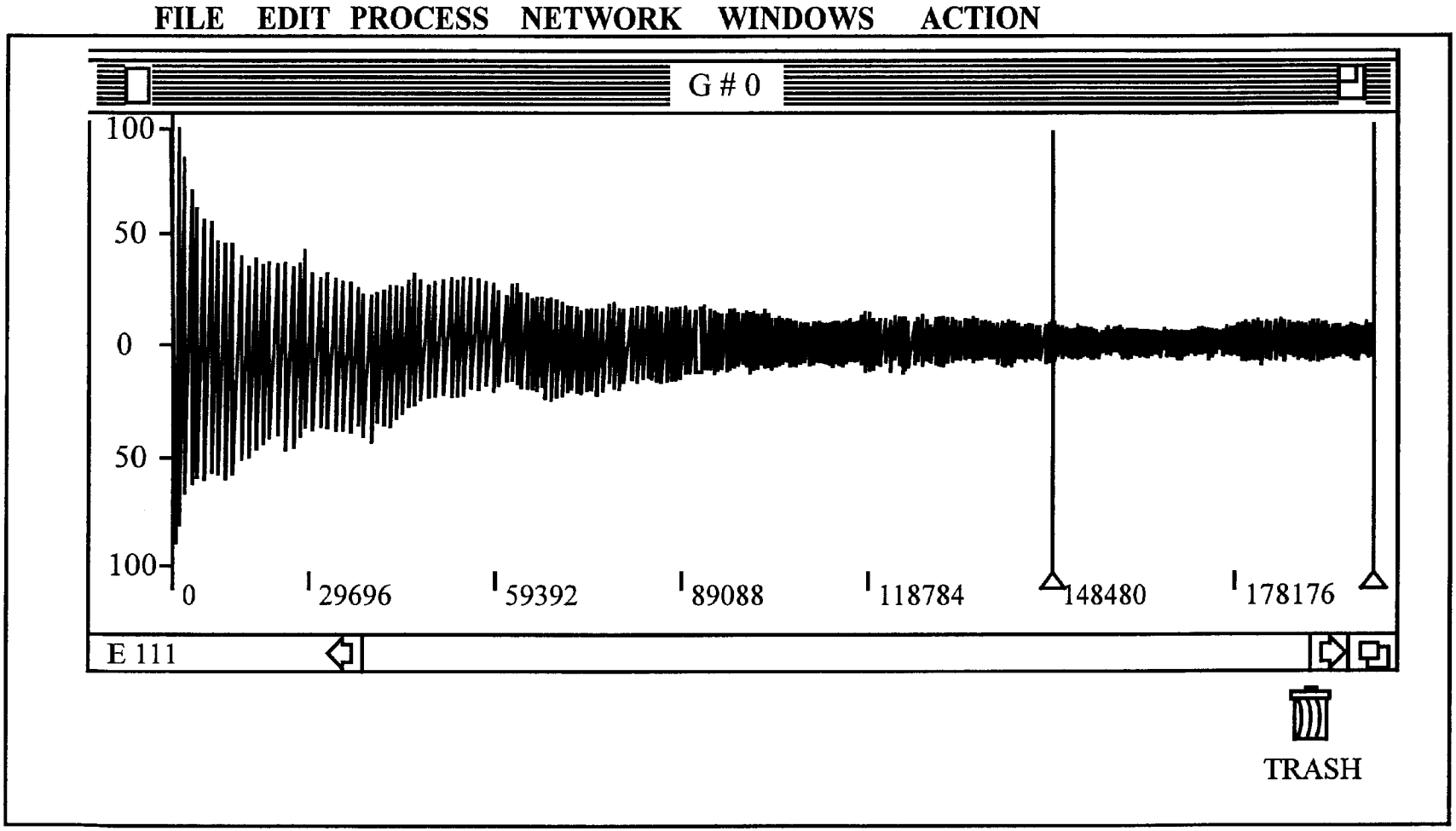
FIG. 7 depicts piano sample with conventional cross/fade loop.
Figure 8:
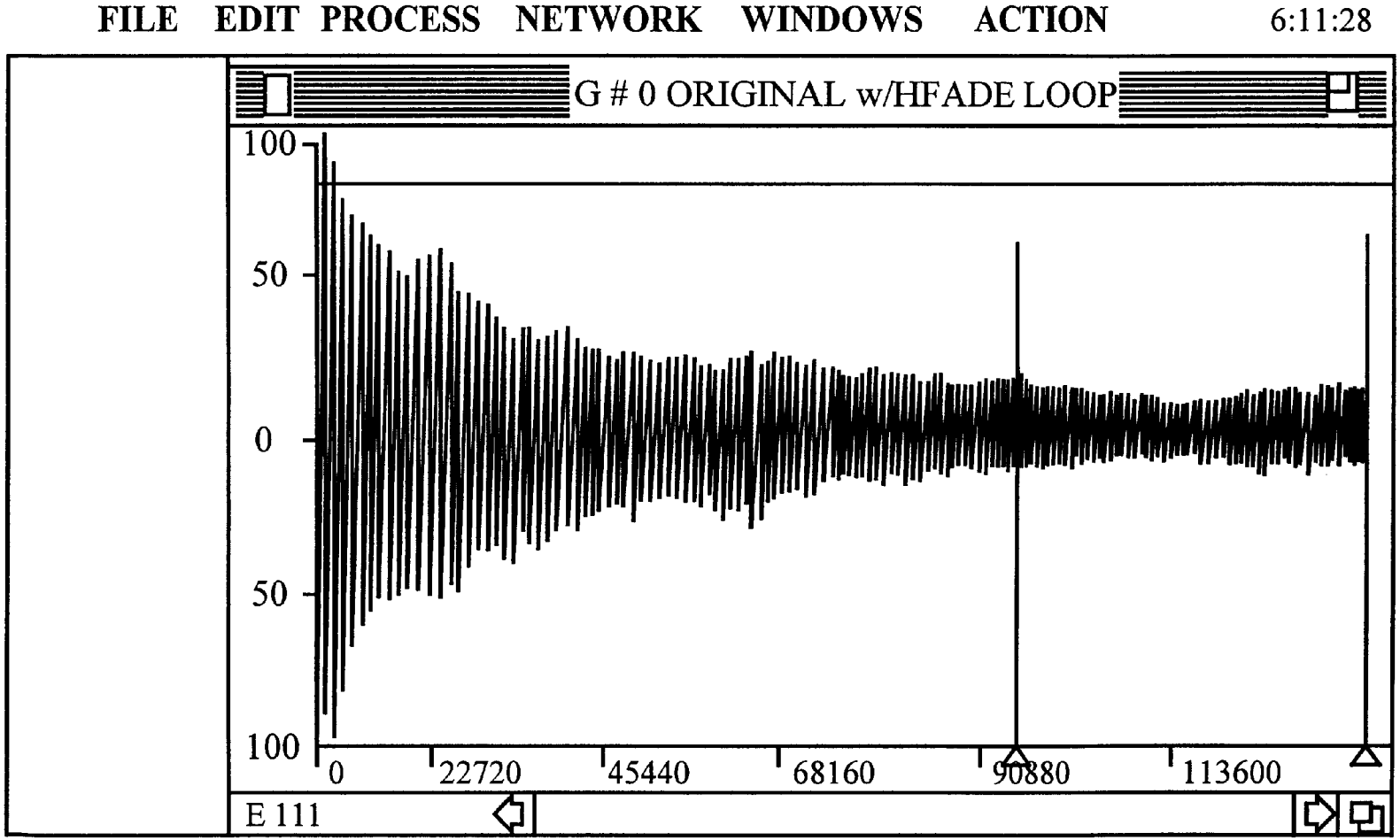
FIG. 8 depicts piano sample with conventional cross/fade loop closer to attack, showing fluctuation in loop.

FIG. 7 shows a piano sample that has been crossfade looped. A shorter sample is desired. In this example, a single cycle loop of the original sample would sound very static and unnatural. Use of a cross-faded loop closer to the attack results in excessive tremolo effects due to the amount of animation still present in the looping area of the sound and the phase cancellation byproducts of crossfading, as shown in FIG. 8.

The variations of lower frequency components in the loop are what cause the undesirable tremolo effects, but variations of higher frequency components in the loop are useful to maintain an animated sound. Bandsplitting the shorter sample allows the low-frequency components to be single-cycle looped, and the high-frequency components to use crossfaded loops. The result after recombining the bands is a loop that sounds stable but still animated.

Figure 9:
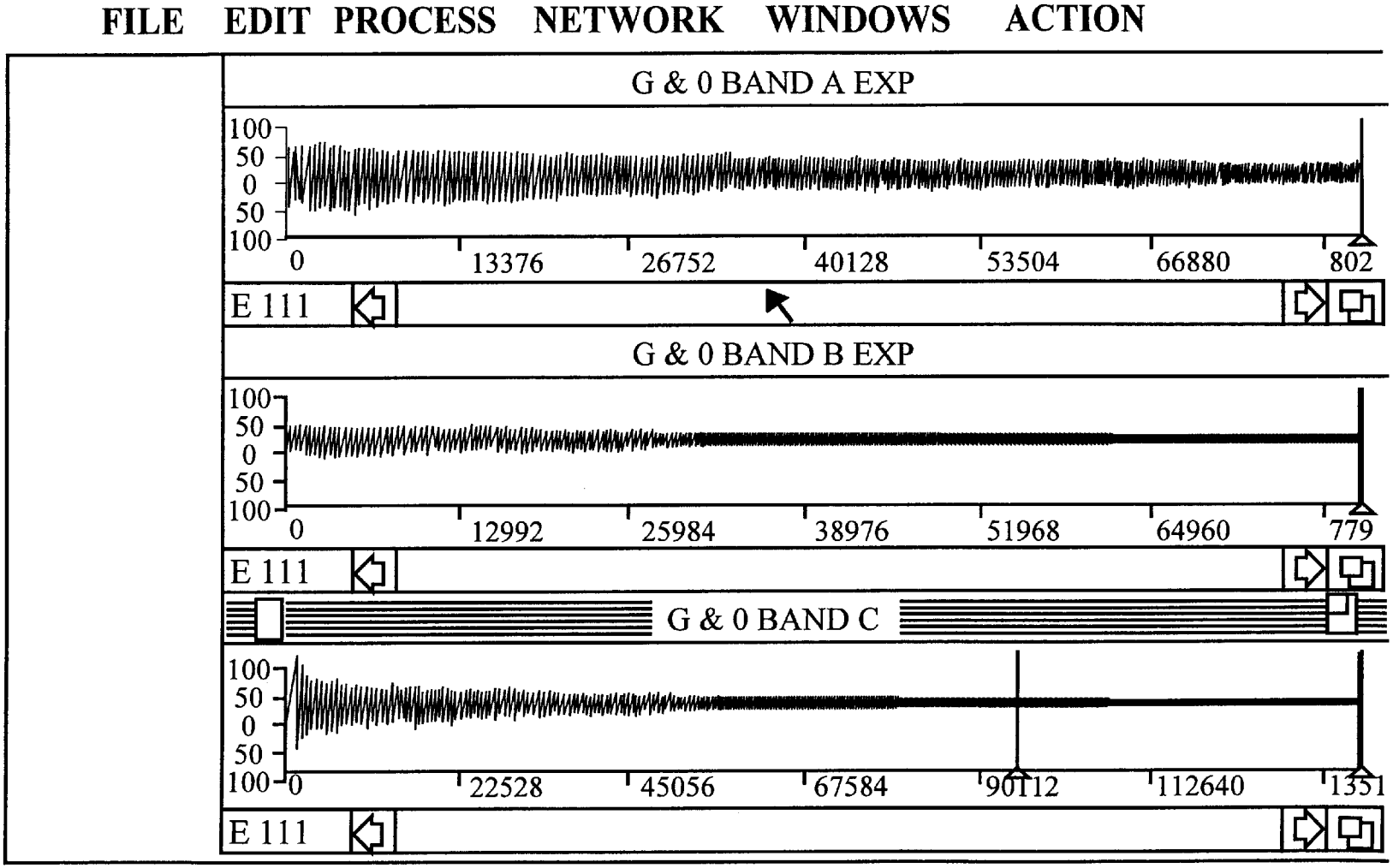
FIG. 9 depicts piano sample band split and looped separately.
Figure 15:
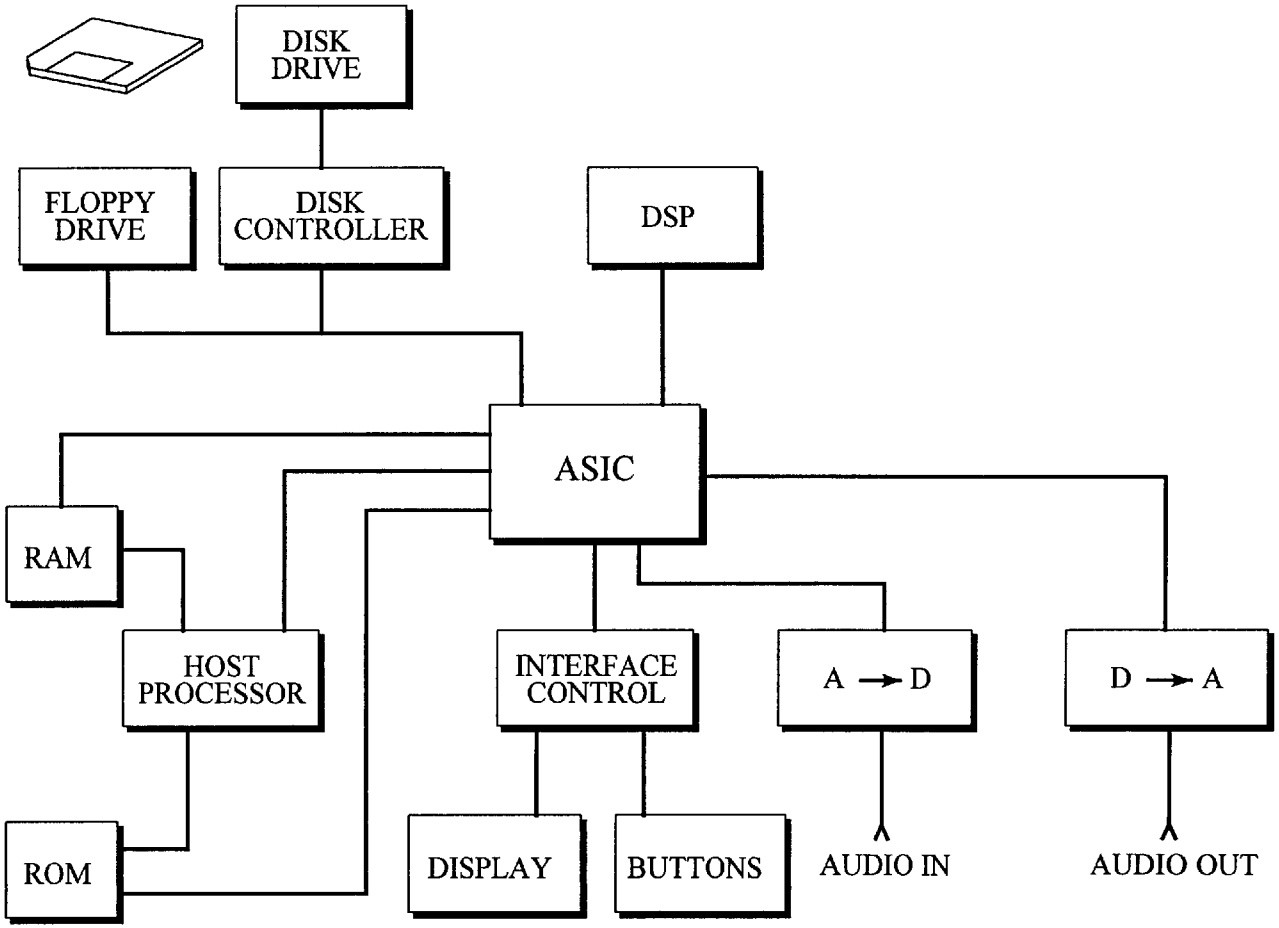
FIG. 15 is a block diagram of a signal processing system suitable for implementing the present invention.

In FIG. 9, the piano sample has been split into three bands using a lowpass, bandpass and highpass phase-linear filter. FIG. 15 depicts a signal processing system 100 suitable for implementing the present invention. In one embodiment, signal processing system 100 captures sound samples, processes the sound samples, and plays out the processed sound samples. The present invention is, however, not limited to processing of sound samples but also may find application in processing, e.g., video signals, remote sensing data, geophysical data, etc. Signal processing system 100 includes a host processor 102, RAM 104, ROM 106, an interface controller 108, a display 110, a set of buttons 112, an analog-to-digital (A-D) converter 114, a digital-to-analog (D-A) converter 116, an application-specific integrated circuit (ASIC) 118, a digital signal processor 120, a disk controller 122, a hard disk drive 124, and a floppy drive 126. Band A has been lowpassed, leaving mostly the fundamental frequency (51 hz, G#0). Band B has been bandpassed, leaving only the second harmonic. Band C has been highpassed, leaving the remainder of the sound.

Band A is looped using a single cycle loop and band B is looped at the same length (which is actually a double cycle loop). Band C is looped using a much longer crossfade loop. The only restriction here is that the longest loop length of all the bands must be an integer multiple of the other loop lengths to allow for proper recombination later. In this case, loops in A and B are 850 bytes and the loop in C is 45900 bytes (54 times as long).

Figure 10:
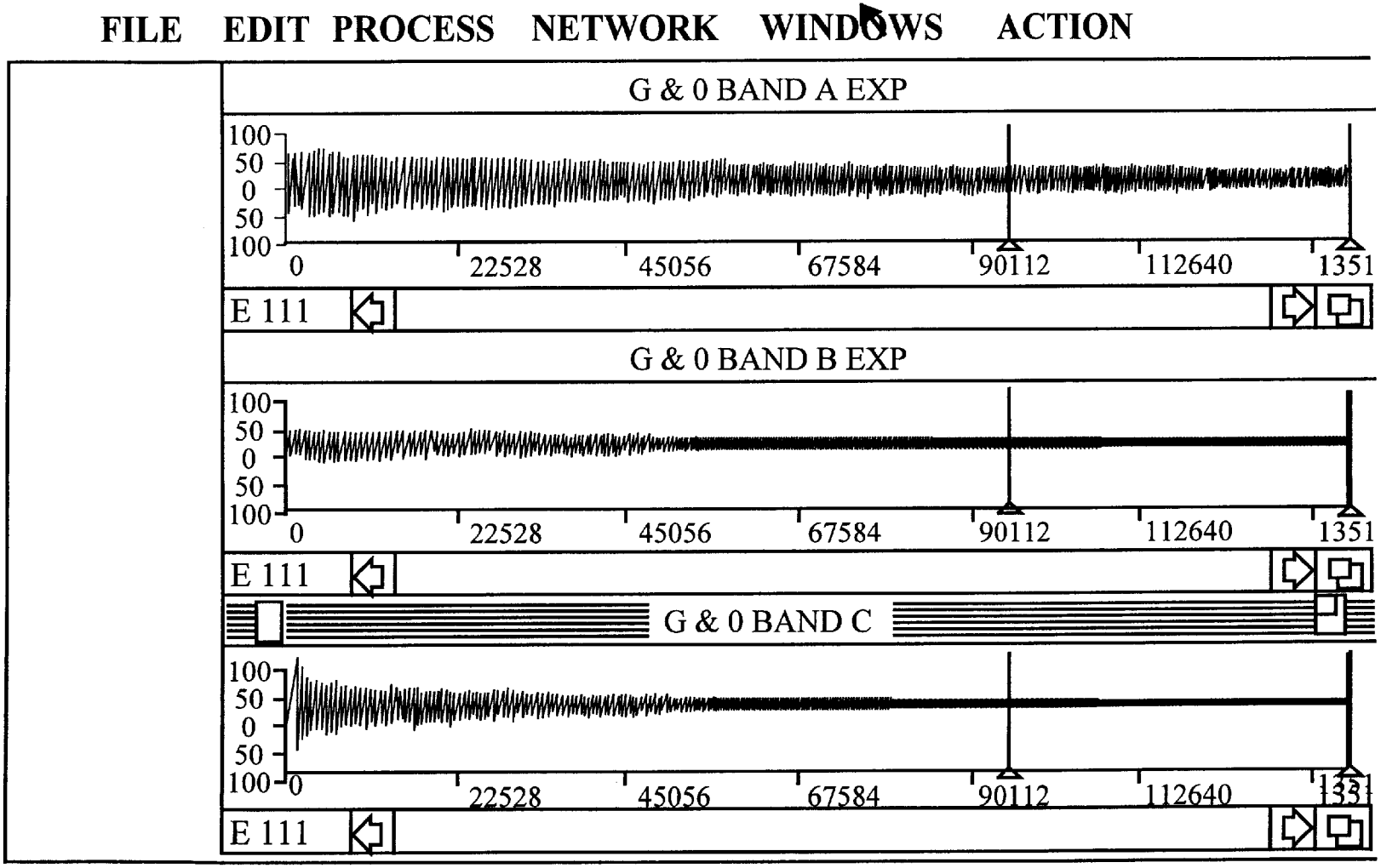
FIG. 10 depicts piano sample band split and loops equalized.

In order to recombine the three bands back into one sample, the loop lengths must first be equalized (FIG. 10). This is accomplished by first copying the loop data in band A many times until a loop length equal to that of C is achieved. In this case, multiplying the loop 54 times provides the correct loop length, but the loop start must also occur at exactly the same point. Simply moving the loop start points of band A to that of band C may result in a less desirable band A loop. Therefore, the loop data in band A should be copied an additional number of times until enough data is created to produce a loop length of 45900 bytes at a start point equal to band C, 94779 bytes. This process is repeated for band B, yielding three bands that all have loops which start at 94779 bytes and are 45900 bytes in length.

Figure 11:
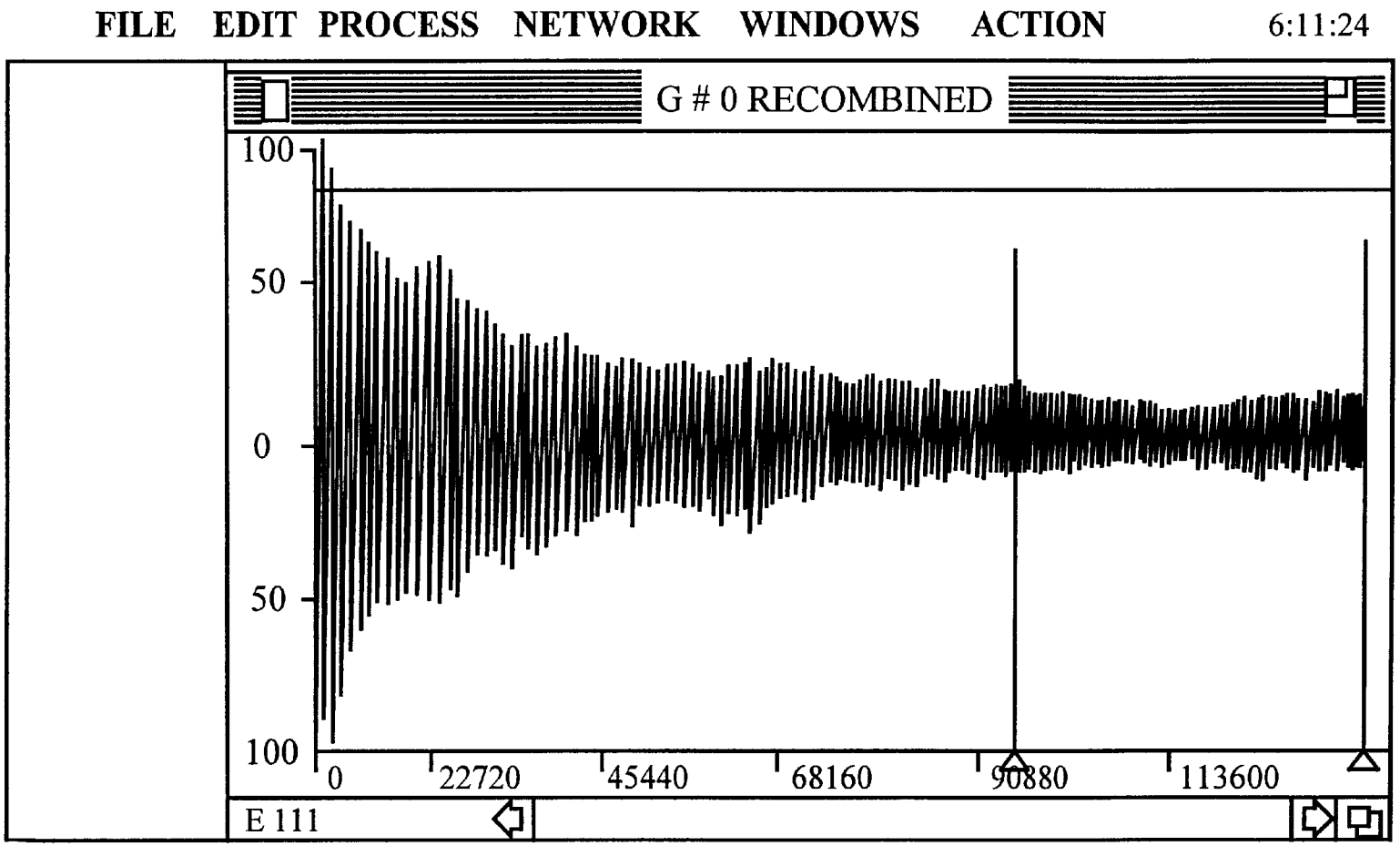
FIG. 11 depicts piano sample bands recombined with a resultant loop closer to attack.

With the loops equalized, the three bands can now be recombined (FIG. 11). The resultant sample has a very natural sustain with some motion in the higher frequencies and very little in the lower ranges. If the original sample had been looped using conventional X/fade looping methods, it would be necessary to start the loop much further from the attach to achieve a similar loop stability (FIG. 7). Otherwise, the sample would contain phase cancellation defects in the low end, which can be observed in FIG. 8.

A third data compression technique according to the present invention combines two or more pitches of ensemble sounds into one sample, thereby creating larger sounds in less memory, as well as reducing formant distortion due to pitch-shifting.

When a fixed-formant sampled sound is shifted flat or sharp upon playback, it sounds uncharacteristic. An obvious example would be a single section vocal "aah" sample stretched up and down 'an octave. The sizes of the vocalists seem to grow and shrink unrealistically. This phenomenon is sometimes called "munchkinization."

Figure 12:
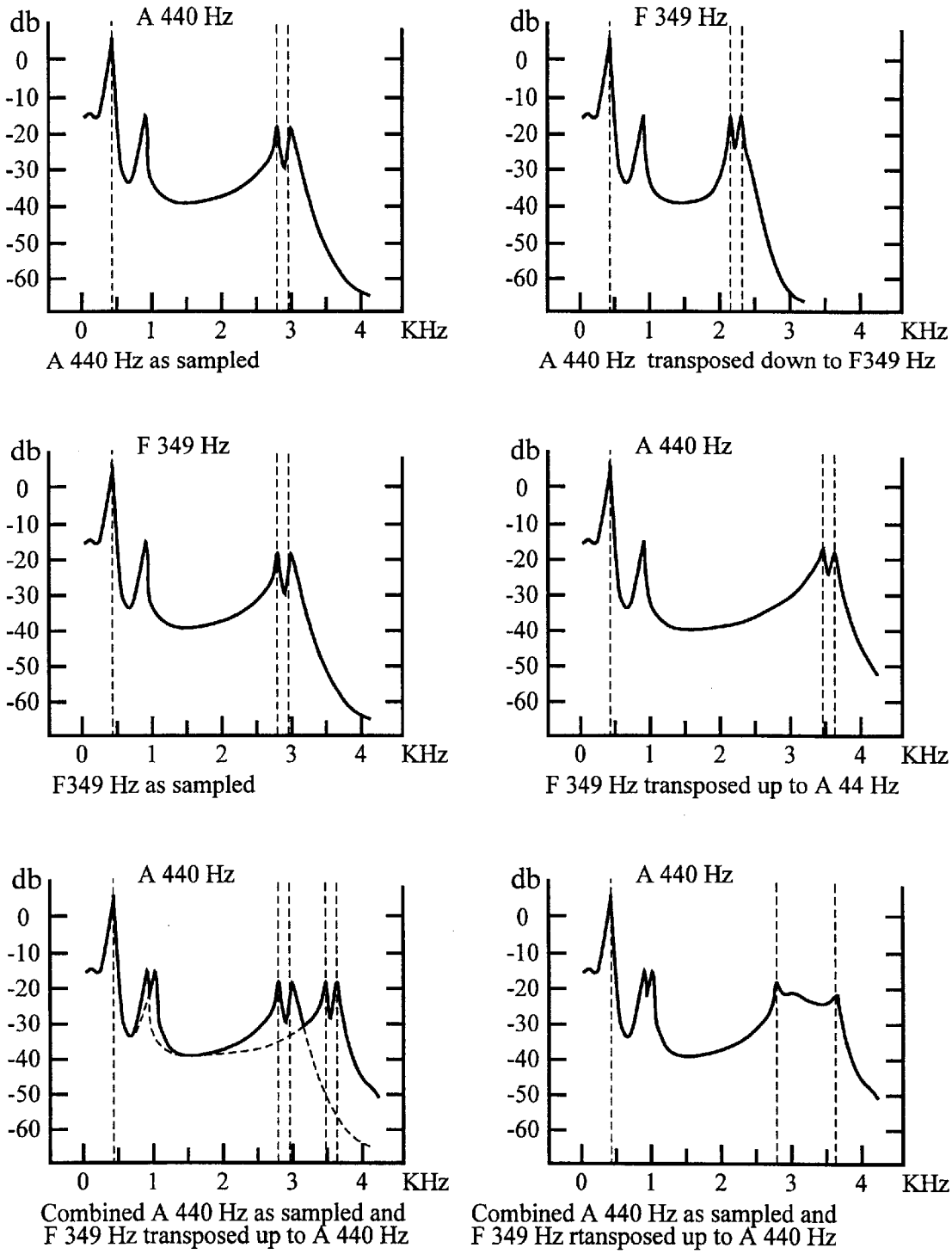
FIG. 12 depicts formant shifting.

FIG. 12 illustrates formant transposition as a result of pitch—shifting the vowel "aW' from A 440 Hz to F 349 Hz and from F 349 Hz to A440 Hz. When compared with the original pitches, the transposed versions exhibit a deviation in formant location.

By digitally re-tuning F 349 Hz to A440 Hz, then digitally combining it with the original A 440 Hz sample, the resultant formant location more closely approximates that of the original A 440 Hz sample. Also, since the combined version contains formant characteristics of both pitches, the effective transposition range has been increased and a larger section sound produced within each sample.

Figure 13:
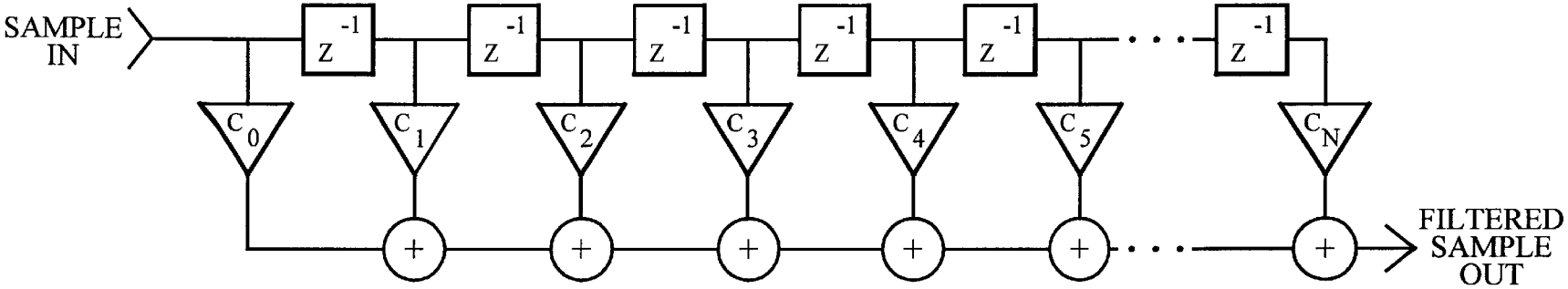
FIG. 13 depicts a diagram of a digital finite impulse response (FIR) filter.

Referring now to FIG. 13, there is shown therein a' digital finite impulse response filter. The filter coefficients, Ci, must all be real to insure a linear phase response. The order of the filter is the number of stages, N.

Figure 14:
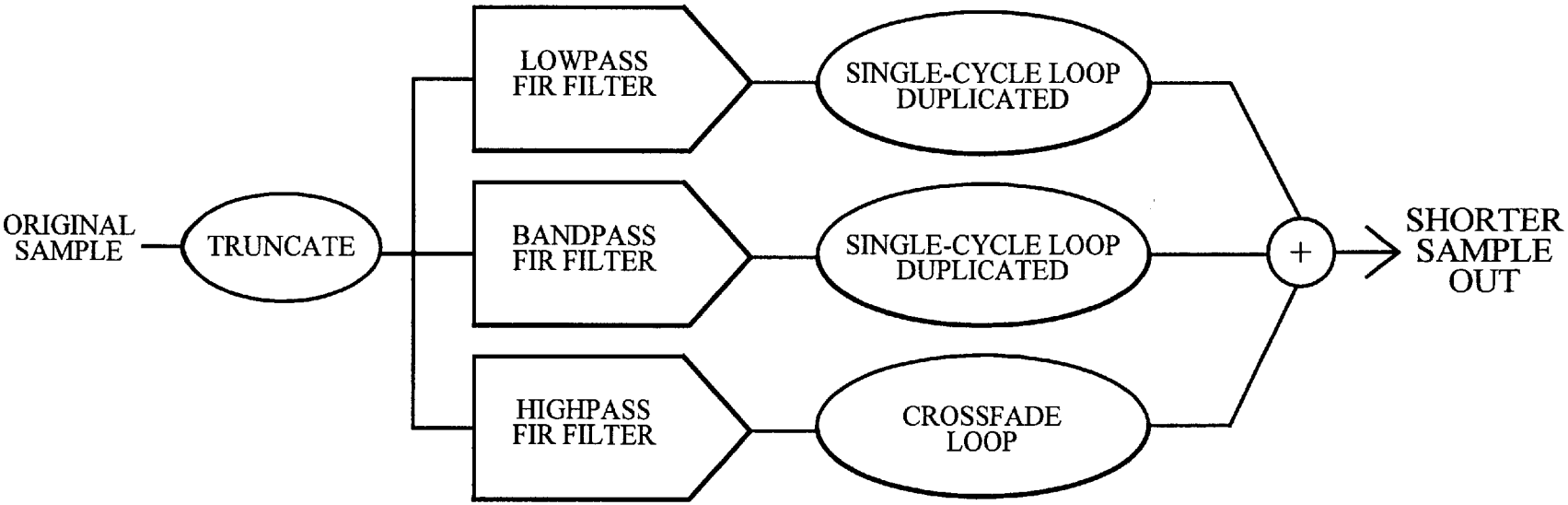
FIG. 14 depicts a diagram of a data compression technique in which lowpass, bandpass and highpass FIR filters are utilized.

FIG. 14 illustrates a data compression technique according to the present invention in which the original sample is truncated, band split (in this case, into three bands), separately looped, and then recombined. The result is much shorter sample. All band split filters in FIG. 14 are of the same order to insure phase consistency upon recombination.

In FIG. 14, after truncation lowpass, bandpass and highpass filtering is performed, as described above. The output of the lowpass FIR filter is then single cycle loop duplicated.

The output of the bandpass FIR filter is single cycle loop duplicated.

The output of the highpass FIR filter is cross/fade looped. The looped bands are then combined, as shown in FIG. 14.

The aspects of the present invention can be achieved by utilizing suitable digital sampling keyboard instruments such as the EMULATOR III which is manufactured by the same applicant as the present invention herein, namely E-mu Systems, Inc. of Scotts Valley, Calif. Also, commercially available sound processing software can be utilized in conjunction with such a suitable digital sampling instrument to provide data compression of sound data according to the present invention.

The foregoing description of the preferred embodiment of the present invention has been presented for purposes of illustration and description. It is not intended to be exhaustive or to limit the invention to the precise form disclosed, and many modifications and variations are possible in light of the above teaching. The preferred embodiment was chosen and described in order to best explain the principles of the invention and its practical applications to thereby enable others skilled in the art to best utilize the invention and with various embodiments and with various modifications as are suited to the particular use contemplated. It is intended that the scope of the invention be defined only by the claims appended hereto.

What is claimed is:

1. A method for compressing sound data, the method comprising the steps of:

providing a sound data sample comprising an attack segment and a loop segment following said attack segment;

deleting a portion of said attack segment before the end of said attack segment to form a beginning attack portion and an end attack portion; and digitally splicing said beginning attack portion and said end attack portion to form a shorter attack segment.

2. The method as in claim 1 wherein said splicing step includes the step of cross fading said beginning attack portion and said end attack portion.

3. The method as in claim 2 wherein said deleting step forms an end attack portion of a predetermined length.

4. The method as in claim 3 wherein said predetermined length is approximately 100 milliseconds.

5. A data compression apparatus for the compression of sound data, the apparatus comprising:

means for providing a sound data sample comprising an attack segment and a loop segment following said attack segment;

means for deleting a portion of said attack segment before the end of said attack segment to form a beginning attack portion and an end attack portion; and means for digitally splicing said beginning attack portion and said end attack portion to form a shorter attack segment.

6. A data compression method for the compression of sound data, the method comprising the steps of:

sampling a first sound sample having a fixed formant and produced at a first pitch to form a first data sample;

sampling a second sound sample having said fixed formant and produced at a second pitch to form a second data sample;

pitch shifting said second data sample from said second pitch to said first pitch to form a third data sample having a formant shifted in frequency location;

combining said first data sample with said third data sample to form a combined sound data sample at said first pitch and having formant characteristics of said fixed formant and said shifted formant.

7. A data compression apparatus for the compression of sound data, the apparatus comprising:

means for sampling a first sound sample having a fixed formant and produced at a first pitch to form a first data sample;

means for sampling a second sound sample having said fixed formant and produced at a second pitch to form a second data sample;

means for pitch shifting said second data sample from said second pitch to said first pitch to form a third data sample having a formant shifted in frequency location;

means for combining said first data sample with said third data sample to form a combined sound data sample at said first pitch and having formant characteristics of said fixed formant and said shifted formant.

8. A method for converting fixed formant sound data into sound data having an increased pitch shifting range, the method comprising the steps of:

providing first and second sound data samples of a fixed formant sound produced at first and second pitches, respectively;

sampling said first and second sound samples to form first and second data samples, respectively;

pitch shifting said second data sample from said second pitch to said first pitch to form a formant shifted data sample;

combining said formant shifted data sample with said first data sample to form a combined sound data sample having formant characteristics of said formant shifted data sample and said first data sample.

9. In a system for compressing sound data, a computer readable medium having computer-executable instructions for performing the steps of:

providing a sound data sample comprising an attack segment and a loop segment following said attack segment;

deleting a portion of said attack segment before the end of said attack segment to form a beginning attack portion and an end attack portion; and digitally splicing said beginning attack portion and said end attack portion to form a shorter attack segment.

10. A computer-readable medium having computer-executable instructions as defined in claim 9 wherein said splicing step includes the step of cross fading said beginning attack segment and said end attack end attack segment.

11. A computer-readable medium having computer-executable instructions as defined in claim 10 wherein said end attack segment is of a predetermined length.

12. A computer-readable medium having computer-executable instructions as defined in claim 11 wherein said predetermined length is approximately 100 milliseconds.

* * * * *